US011299383B2

(12) United States Patent
Rider et al.

(10) Patent No.: US 11,299,383 B2
(45) **Date of Patent: *Apr. 12, 2022**

(54) BEVERAGE EXTRACTOR WITH CONTROLLER

(71) Applicant: Coravin, Inc., Bedford, MA (US)

(72) Inventors: Michael Rider, Lowell, MA (US); Gregory Lambrecht, Natick, MA (US); Andrew S. Sweezey, Malden, MA (US); Chris Vogt, Somerville, MA (US)

(73) Assignee: Coravin, Inc., Bedford, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/316,816

(22) Filed: May 11, 2021

(65) Prior Publication Data

US 2021/0261398 A1 Aug. 26, 2021

Related U.S. Application Data

(63) Continuation of application No. 16/711,631, filed on Dec. 12, 2019, now Pat. No. 11,059,712, which is a (Continued)

(51) Int. Cl.
*B67D 1/04* (2006.01)
*B67D 3/00* (2006.01)

(Continued)

(52) U.S. Cl.
CPC ..... *B67D 1/0412* (2013.01); *B67D 1/0004* (2013.01); *B67D 1/0085* (2013.01);

(Continued)

(58) Field of Classification Search
CPC .. B67D 1/0412; B67D 1/0004; B67D 1/0085; B67D 1/0801; B67D 1/0878;

(Continued)

(56) References Cited

U.S. PATENT DOCUMENTS 3,341,073 A 9/1967 Arps et al.
3,883,043 A 5/1975 Lane (Continued)

FOREIGN PATENT DOCUMENTS

CN 1735554 A 2/2006
CN 101605716 A 12/2009

(Continued)

OTHER PUBLICATIONS

Invitation to Pay Additional Fees for International Application No. PCT/US2016/063261, dated Feb. 6, 2017.

(Continued)

*Primary Examiner* — Paul R Durand
*Assistant Examiner* — Michael J. Melaragno
(74) *Attorney, Agent, or Firm* — Wolf, Greenfield & Sacks, P.C.

(57) ABSTRACT

A system and method for dispensing beverage from a container, such as wine from a wine bottle. Dispensing may be automatically controlled based on a detected orientation of the container, e.g., dispensing may occur when a bottle is tilted as if to pour from the bottle and stopped when the bottle is oriented upright. Dispensing may be stopped when the container is rotated about its longitudinal axis even while in a pour orientation. A remaining amount of beverage in the container and/or an amount of pressurized gas used to drive dispensing may be detected and beverage dispensing controlled accordingly.

22 Claims, 10 Drawing Sheets

Related U.S. Application Data continuation of application No. 15/358,236, filed on Nov. 22, 2016, now Pat. No. 10,519,021.

(60) Provisional application No. 62/259,908, filed on Nov. 25, 2015.

(51) Int. Cl.
*B67D 1/08* (2006.01)
*B67D 1/00* (2006.01)
*B67D 1/12* (2006.01)

(52) U.S. Cl.
CPC ..... *B67D 1/0801* (2013.01); *B67D 1/0878* (2013.01); *B67D 1/0885* (2013.01); *B67D 3/0003* (2013.01); *B67D 3/0051* (2013.01); *B67D 1/1277* (2013.01); *B67D 3/0006* (2013.01); *B67D 2001/0087* (2013.01); *B67D 2001/0092* (2013.01); *B67D 2001/0098* (2013.01); *B67D 2001/0812* (2013.01); *B67D 2001/1259* (2013.01); *B67D 2210/00091* (2013.01)

(58) Field of Classification Search
CPC .. B67D 1/0885; B67D 3/0003; B67D 3/0051; B67D 1/1277
USPC ..... 222/52–69, 400.7
See application file for complete search history.

(56) References Cited

U.S. PATENT DOCUMENTS 3,927,801 A 12/1975 Martin et al.
3,976,221 A 8/1976 Martin et al.
4,265,370 A 5/1981 Reilly
4,464,956 A 8/1984 Hashimoto
4,473,174 A 9/1984 Heuser
4,984,711 A 1/1991 Ellis
5,020,395 A 6/1991 Mackey
5,199,607 A 4/1993 Shimano
5,255,819 A 10/1993 Peckels
5,318,197 A 6/1994 Martindale et al.
5,335,705 A 8/1994 Morishita et al.
5,395,012 A 3/1995 Grill et al.
5,505,349 A 4/1996 Peckels
5,507,411 A 4/1996 Peckels
6,186,745 B1 2/2001 Johnson
6,306,658 B1 10/2001 Turner et al.
6,409,046 B1 6/2002 Peckels
6,477,920 B1 11/2002 Yang
6,530,400 B2 3/2003 Nelson
6,553,779 B1 4/2003 Boyer et al.
7,109,863 B2 9/2006 Morrison
7,190,278 B2 3/2007 Morrison
7,204,158 B2 4/2007 Morgan et al.
7,260,504 B2 8/2007 Mogadam
7,272,537 B2 9/2007 Mogadam
7,340,559 B2 3/2008 Ito et al.
7,395,949 B2 7/2008 Ehret et al.
7,478,737 B2 1/2009 Gosi et al.
7,533,701 B2 5/2009 Gadzic et al.
7,597,124 B2 * 10/2009 Litto ..... B67D 1/0878 141/114
7,712,637 B2 5/2010 Lambrecht
7,823,411 B2 11/2010 Gagliano et al.
7,982,868 B2 7/2011 Akkerman et al.
8,141,746 B2 3/2012 Lambrecht
8,225,959 B2 7/2012 Lambrecht
8,272,538 B2 9/2012 Weinberg et al.
8,348,097 B2 1/2013 Nishino
8,453,878 B2 6/2013 Palmquist
8,490,832 B2 7/2013 Lambrecht
8,496,139 B2 7/2013 Nishino
D689,353 S 9/2013 Dockser et al.
8,640,919 B2 2/2014 Lambrecht
8,746,502 B2 6/2014 Lambrecht
D709,163 S 7/2014 Deruntz et al.
8,783,166 B2 7/2014 Kramer
8,833,405 B2 9/2014 Phallen et al.
D717,578 S 11/2014 Lazaris et al.
8,910,829 B2 12/2014 Lazaris et al.
8,919,610 B2 12/2014 Haley et al.
8,925,756 B2 1/2015 Tarapata et al.
9,010,588 B2 4/2015 Lambrecht
9,016,502 B2 4/2015 Hollars et al.
9,016,517 B2 4/2015 Craft
9,061,877 B2 6/2015 Lazaris
9,061,878 B2 6/2015 Lambrecht
9,133,008 B2 9/2015 Rider et al.
9,139,411 B2 9/2015 Rider et al.
9,139,412 B2 9/2015 Lambrecht
9,181,021 B2 11/2015 Manera
9,284,177 B2 * 3/2016 Litto ..... B67D 1/12
D755,554 S 5/2016 Lazaris et al.
9,394,155 B2 7/2016 Phallen et al.
9,422,144 B2 8/2016 Lambrecht
9,428,374 B2 8/2016 Houck et al.
9,441,790 B2 9/2016 Tarapata et al.
D778,125 S 2/2017 Metaxatos et al.
9,708,575 B2 7/2017 Koretz et al.
9,718,665 B2 8/2017 Wittrup et al.
9,739,388 B2 8/2017 Rider et al.
9,758,362 B2 9/2017 Rider et al.
D801,129 S 10/2017 Metaxatos et al.
9,810,375 B2 11/2017 Rider et al.
9,914,631 B2 3/2018 Manwani et al.
D826,617 S 8/2018 Rider et al.
10,399,751 B2 * 9/2019 Lambrecht ..... B67D 1/0412
10,519,021 B2 * 12/2019 Rider ..... B67D 1/0412
10,994,904 B2 * 5/2021 Lambrecht ..... B65D 41/0442
11,046,502 B2 * 6/2021 Rider ..... B65D 83/382
11,059,712 B2 * 7/2021 Rider ..... B67D 1/0885
11,180,309 B2 * 11/2021 Rider ..... B65D 83/44
2003/0055589 A1 3/2003 Mogadam
2005/0098225 A1 5/2005 Chantalat
2005/0178801 A1 8/2005 Lambrecht
2006/0016511 A1 1/2006 Chantalat
2006/0163290 A1 7/2006 Ehret
2007/0119875 A1 5/2007 Ehret
2007/0193653 A1 8/2007 Gagliano
2007/0204930 A1 9/2007 Phallen
2008/0141702 A1 6/2008 Gagliano
2008/0142115 A1 6/2008 Vogt
2008/0202148 A1 8/2008 Gagliano
2010/0006603 A1 1/2010 Weinberg
2010/0038378 A1 2/2010 Gabler
2010/0155419 A1 6/2010 Nishino
2011/0042418 A1 2/2011 Lambrecht
2011/0056998 A1 3/2011 Lambrecht
2011/0204093 A1 8/2011 Lee
2012/0031927 A1 2/2012 Rivier
2012/0080445 A1 4/2012 Moezidis
2012/0241476 A1 9/2012 Lambrecht
2012/0285988 A1 11/2012 Lambrecht
2013/0119085 A1 5/2013 Nishino
2013/0292423 A1 11/2013 Lambrecht
2013/0306673 A1 11/2013 Manera
2013/0341348 A1 12/2013 Lambrecht
2013/0341363 A1 12/2013 Scott
2014/0042703 A1 2/2014 Tarapata
2014/0097184 A1 4/2014 Hollars
2014/0097198 A1 4/2014 Lazaris
2014/0103065 A1 4/2014 Lambrecht
2014/0110431 A1 4/2014 Lambrecht
2014/0124530 A1 5/2014 Craft
2014/0224833 A1 8/2014 Lambrecht
2014/0252046 A1 9/2014 Rider
2014/0263430 A1 9/2014 Keating
2014/0312060 A1 10/2014 Heatherly et al.
2014/0367415 A1 12/2014 Rider
2014/0374441 A1 12/2014 Lazaris
2015/0069085 A1 3/2015 Lambrecht
2015/0083734 A1 3/2015 Tarapata

(56) References Cited

U.S. PATENT DOCUMENTS

| | | | | |
|---|---|---|---|---|
| 2015/0191340 | A1 | 7/2015 | Lambrecht | |
| 2015/0284163 | A1 | 10/2015 | Manwani | |
| 2015/0285775 | A1 | 10/2015 | Gurumohan | |
| 2015/0293067 | A1 | 10/2015 | Greene | |
| 2015/0307339 | A1 | 10/2015 | Kao | |
| 2015/0345651 | A1 | 12/2015 | Rider | |
| 2016/0175781 | A1 | 6/2016 | Hubbard, Jr | |
| 2016/0177243 | A1 | 6/2016 | Koretz | |
| 2016/0203431 | A1 | 7/2016 | Renfroe | |
| 2016/0257554 | A1 | 9/2016 | Manwani | |
| 2017/0001850 | A1 | 1/2017 | Rider | |
| 2017/0002980 | A1 | 1/2017 | Rider | |
| 2017/0022040 | A1 | 1/2017 | Koretz | |
| 2017/0137275 | A1 | 5/2017 | Lambrecht | |
| 2017/0144877 | A1* | 5/2017 | Rider | B67D 1/0412 |
| 2017/0334704 | A1 | 11/2017 | Koretz | |
| 2017/0349868 | A1 | 12/2017 | Koretz | |
| 2017/0361999 | A1* | 12/2017 | Lambrecht | B65D 51/245 |
| 2018/0162717 | A1 | 6/2018 | Manwani | |
| 2018/0194607 | A1 | 7/2018 | Diffenderfer | |
| 2018/0211558 | A1 | 7/2018 | Lau | |
| 2018/0290873 | A1 | 10/2018 | Zhu | |
| 2018/0327243 | A1* | 11/2018 | Rider | B67D 1/0884 |
| 2019/0202680 | A1* | 7/2019 | Rider | B67D 1/0412 |
| 2019/0352062 | A1* | 11/2019 | Lambrecht | B65D 41/0442 |
| 2020/0115210 | A1* | 4/2020 | Rider | B67D 1/0878 |
| 2020/0156857 | A1* | 5/2020 | Rider | B65D 83/66 |
| 2020/0156858 | A1* | 5/2020 | Rider | B65D 83/382 |
| 2021/0261398 | A1* | 8/2021 | Rider | B67D 1/0004 |

FOREIGN PATENT DOCUMENTS

| | | | |
|---|---|---|---|
| CN | 102803073 | A | 11/2012 |
| CN | 104507850 | A | 4/2015 |
| JP | 2006-327683 | A | 12/2006 |
| WO | 2005/058744 | A2 | 6/2005 |

OTHER PUBLICATIONS

International Search Report and Written Opinion for International Application No. PCT/US2016/063261, dated Mar. 29, 2017.

International Preliminary Report on Patentability for International Application No. PCT/US2016/063261, dated Jun. 7, 2018.

* cited by examiner

BEVERAGE EXTRACTOR WITH CONTROLLER

RELATED APPLICATIONS

This Application is a continuation of U.S. application Ser. No. 16/711,631, filed Dec. 12, 2019, which is a continuation of U.S. application Ser. No. 15/358,236, filed Nov. 22, 2016, which claims priority under 35 U.S.C. § 119(e) to U.S. Provisional Application Ser. No. 62/259,908, filed Nov. 25, 2015, each of which is herein incorporated by reference in its entirety.

BACKGROUND OF INVENTION

This invention relates generally to the dispensing or other extraction of fluids from within a container, e.g., in the dispensing of wine from a wine bottle.

SUMMARY OF INVENTION

One or more embodiments in accordance with aspects of the invention allow a user to withdraw or otherwise extract a beverage, such as wine, from within a bottle that is sealed by a cork, plug, elastomeric septum or other closure without removing the closure. In some cases, removal of liquid from such a bottle may be performed one or more times, yet the closure may remain in place during and after each beverage extraction to maintain a seal for the bottle. Thus, the beverage may be dispensed from the bottle multiple times and stored for extended periods between each extraction with little or no effect on beverage quality. In some embodiments, little or no gas, such as air, which is reactive with the beverage may be introduced into the bottle either during or after extraction of beverage from within the bottle. Thus, in some embodiments, a user may withdraw wine from a wine bottle without removal of, or damage to, the cork, and without allowing air or other potentially damaging gasses or liquids entry into the bottle.

In some embodiments, a beverage extractor may be secured to the neck of the bottle, such as by clamping a portion of the extractor to the bottle neck, and a needle of the beverage extractor may be inserted through the closure (such as a cork of a wine bottle) so that a distal end of the needle is positioned inside of the bottle. Thereafter, pressurized gas may be injected into the bottle via the needle while the bottle is positioned in the bottle support sleeve. The injected gas may be pressure regulated, e.g., to a pressure of 20-50 psi, or not regulated. For example, pressure in the bottle may allow beverage to flow through the needle and out of the bottle. In some embodiments, the extractor needle may include two lumens or two needles, one for gas and another for beverage, e.g., so that gas may be injected simultaneously with beverage flow out of the bottle.

In one embodiment, a container-mounted beverage dispensing system includes at least one conduit to deliver gas into a container holding a beverage and to receive beverage from the container for dispensing in a user's cup. For example, a single or multiple lumen needle or other conduit may be provided and arranged to be inserted through a cork or other closure of a wine bottle. At least one valve may be used to control gas flow into the container or beverage flow out of the container via the at least one conduit. For example, a gas control valve may be arranged to control flow of gas from a source of pressurized gas to the at least one conduit, and a beverage control valve may be arranged to control flow of beverage from the at least one conduit to a beverage outlet. A container orientation sensor may detect whether the container is in a pour orientation or a no-pour orientation, and a controller may be arranged to control the at least one valve to allow gas or beverage flow in the at least one conduit when the container is in a pour orientation and to control the at least one valve to prohibit gas or beverage flow when the container is in a no-pour orientation. For example, the container orientation sensor may detect a pour condition when a bottom of the container is above an opening of the container, and/or when a longitudinal axis of the container is rotated about a horizontal axis by at least 90 degrees. Thus, for example, a user may tilt or otherwise manipulate a wine bottle or other container in a way similar to that used to conventionally pour beverage from the bottle, and the system may automatically begin or otherwise control dispensing based on container position, as well as stop dispensing when the bottle is tilted back to an upright or nearly upright position.

In some cases, the controller may be arranged to open the at least one valve to allow pressurized gas to flow into the container when the container is in a pour orientation and to close the at least one valve to prohibit pressurized gas to flow into the container when the container is in a no-pour orientation. Such an arrangement may be useful when two conduits are used to access the container where one conduit delivers gas into the container and the other conduit delivers beverage from the container. In another embodiment, the at least one conduit includes a single conduit, and the controller is arranged to alternate between opening the at least one valve to allow pressurized gas to flow into the container via the single conduit and closing the at least one valve to prohibit pressurized gas to flow into the container and allow beverage to flow from the container via the single conduit when the container is in a pour orientation. In another arrangement, the controller may be arranged to open the at least one valve to allow beverage to flow from the at least one conduit to a beverage outlet when the container is in a pour orientation and to close the at least one valve to prohibit beverage to flow from the at least one conduit to the beverage outlet when the container is in a no-pour orientation.

In some embodiments, the controller may be arranged to control the at least one valve to dispense a defined amount of beverage from the container. For example, if a user tilts a bottle so as to conventionally pour from the bottle, the system may automatically dispense a defined amount of beverage, such as 6 ounces, and stop dispensing even if the bottle is kept in a pour orientation. To dispense another serving, the user may be required to put the bottle in a no-pour orientation and then again to a pour orientation. In some embodiments, the controller may be arranged to control the at least one valve in two modes including a first mode for maximized beverage dispensing speed and a second mode for minimized pressurized gas usage. This may allow a user to control the rate at which beverage is dispensed, or to conserve dispensing gas as needed.

In some embodiments, a container-mounted beverage dispensing system includes at least one conduit to deliver gas into a container holding a beverage and to receive beverage from the container for dispensing in a user's cup, and at least one valve to control gas flow into the container or beverage flow out of the container via the at least one conduit. Arrangements for the at least one conduit and valve discussed above may be employed, for example, such as single or multi-lumen needles, a gas control valve, a beverage control valve, etc. A container orientation sensor may detect rotation of the container about its longitudinal axis while in a pour orientation, and a controller may be arranged to control the at least one valve to prohibit gas or beverage flow in response to rotation of the container about the longitudinal axis while in the pour orientation. Thus, for example, a user may rotate a bottle about its longitudinal axis while the bottle is held in a pour orientation and the system may stop beverage dispensing and/or stop gas delivery into the bottle. This arrangement may help the user better stop dispensing and prevent dripping from the bottle. Such a control arrangement may be used with the feature of controlling dispensing based on a container's pour/no-pour orientation as discussed above, or used independently of such a feature.

In another embodiment, a container-mounted beverage dispensing system includes at least one conduit to deliver gas into a container holding a beverage and to receive beverage from the container for dispensing in a user's cup, and at least one valve to control gas flow into the container or beverage flow out of the container via the at least one conduit. Arrangements for the at least one conduit and valve discussed above may be employed, for example. A source of pressurized gas, whether regulated in pressure or not, may be fluidly coupled to the at least one conduit, and a pressure sensor may detect a pressure indicative of gas pressure in the container. That is, pressurized gas from the source of pressurized gas may be delivered to the container via the at least one conduit, and the pressure sensor may detect a pressure indicative of pressure in the container. As mentioned above, one or more valves may be used to control gas flow. A controller may be arranged to determine a volume of beverage in the container based on a change in pressure measured by the pressure sensor over a time period that pressurized gas is delivered to the container or over a time period that beverage is dispensed from the container. For example, the controller may detect a rate at which pressure in the container increases while gas is delivered to the container and based on the rate of pressure increase, determine an amount of liquid beverage in the container. In another embodiment, the controller may detect a rate at which pressure decreases in the container during beverage dispensing, and based on this information determine an amount of beverage in the container. In some embodiments, the controller may determine an amount of beverage dispensed, such as by determining an amount of time that a beverage dispense valve is open to allow beverage to be dispensed. In cases where a flow rate of beverage dispensing is known, e.g., based on gas pressure in the container, the controller may determine an amount of beverage dispensed and subtract that amount from an initial amount of beverage in the container.

In some embodiments, the controller may be arranged to receive information regarding an identity of a container to which the system is mounted, and the controller may store an amount of beverage in the container. This information may be useful where the system is used to dispense beverage, is disengaged from the container, and then reengaged at a later time to dispense beverage. The controller may recall the amount of beverage remaining in the container and control dispensing accordingly, e.g., by controlling gas flow into the container based on an amount of beverage remaining. In some cases, the controller may be arranged to determine an amount of beverage remaining in the container during dispensing based on an amount of gas delivered to the container. For example, the controller may determine an amount of gas delivered to the container based on a time that a gas control valve is open to deliver pressurized gas to the container. Where the gas is pressure regulated or other characteristics of gas flow rate can be known, the controller may determine an amount of gas delivered based on the flow rate and open time for the gas valve.

In some embodiments, a container-mounted beverage dispensing system may include at least one conduit to deliver gas into a container holding a beverage and to receive beverage from the container for dispensing in a user's cup, and at least one valve to control gas flow into the container via the at least one conduit. Arrangements for the at least one conduit and at least one valve discussed above may be employed. A gas cylinder may be fluidly coupled to the at least one conduit, and a controller may be arranged to determine a pressure in the gas cylinder based on an amount of time that the at least one valve is open to deliver gas into the at least one container. For example, a pressure sensor may be used to detect a pressure indicative of gas pressure in the container, and the controller may determine a pressure in the gas cylinder based on an amount of time that the at least one valve is open to deliver gas into the container and a gas pressure in the container. For example, lower gas cylinder pressures may correspond to a lower gas flow rate, and thus a longer time to pressurize a gas space in a container than a gas cylinder with a higher pressure.

Various exemplary embodiments of the device are further depicted and described below.

BRIEF DESCRIPTION OF THE DRAWINGS

Aspects of the invention are described with reference to various embodiments, and to the figures, which include.

DETAILED DESCRIPTION

Figure 1:
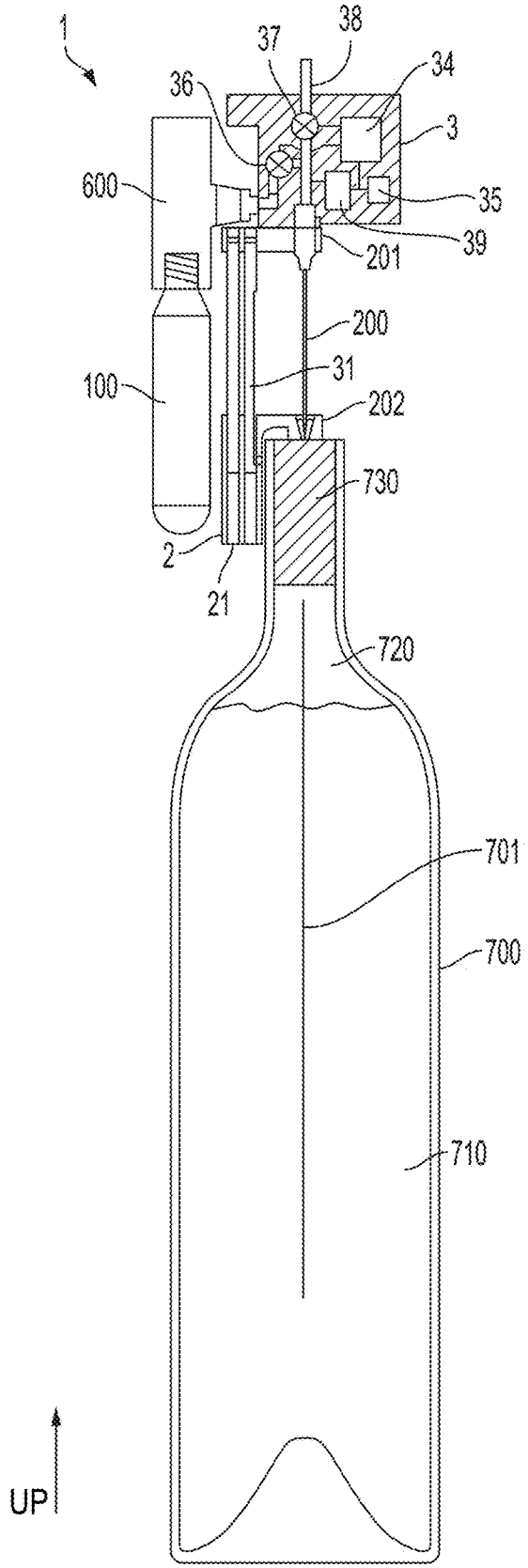
FIG. 1 shows a schematic view of a beverage extraction device in preparation for introducing a conduit through a closure of a beverage bottle.

Aspects of the invention are described below with reference to illustrative embodiments, but it should be understood that aspects of the invention are not to be construed narrowly in view of the specific embodiments described. Thus, aspects of the invention are not limited to the embodiments described herein. It should also be understood that various aspects of the invention may be used alone and/or in any suitable combination with each other, and thus various embodiments should not be interpreted as requiring any particular combination or combinations of features. Instead, one or more features of the embodiments described may be combined with any other suitable features of other embodiments.

FIGS. 1-4 show schematic views of one embodiment of a beverage extraction device (or extractor) 1 that incorporates one or more aspects of the invention. Generally, the device 1 is used to insert a needle or other conduit into a beverage container 700, inject gas into the container 700 via the conduit, and dispense beverage forced out of the container 700 by the injected gas or other pressure in the container. This illustrative device 1 includes a body 3 with an attached source of pressurized gas 100 (such as a compressed gas cylinder) that provides gas under pressure (e.g., 2600 psi or less as dispensed from the cylinder) to a regulator 600. In this arrangement, the cylinder 100 is secured to the body 3 and regulator 600 by a threaded connection, although other configurations are possible, such as those described below and/or in U.S. Pat. Nos. 4,867,209; 5,020,395; and 5,163,909 which are hereby incorporated by reference with respect to their teachings regarding mechanisms for engaging a gas cylinder with a cylinder receiver. The regulator 600 is shown schematically and without detail, but can be any of a variety of commercially available or other single or multi-stage pressure regulators capable of regulating gas pressures to a pre-set or variable outlet pressure. The main function of the regulator 600 is to provide gas at a pressure and flow rate suitable for delivery to the container 700 (such as a wine bottle), e.g., so that a pressure established inside the container 700 does not exceed a desired level. In other embodiments, no pressure regulation of the gas released from the cylinder 100 need be done, and instead, unregulated gas pressure may be delivered to the container 700.

In this embodiment, the body 3 also includes at least one valve to control the flow of gas and/or a flow of beverage from the container 700. In this embodiment, a gas control valve 36 is provided to control the flow of gas from the gas source 100 to a conduit in fluid communication with the interior of the container 700, and a beverage control valve 37 to control the flow of beverage from the container 700 to a dispensing outlet 38. (In some embodiments, the dispensing outlet 38 or a portion of the outlet 38 such as a tube may be removable or replaceable, e.g., for cleaning.) However, other arrangements are possible, e.g., a single valve may control the flow of both gas and beverage (e.g., using a three-way valve), a single valve may be used to control gas flow only (e.g., a beverage flow conduit may be always open from the container interior to the dispensing outlet and beverage may flow as gas is introduced into the container), or a single valve may be used to control beverage flow only (e.g., gas flow from the gas source 100 to the container 700 may be always open with the device 1 engaged with a container 700 and beverage flow may be controlled by opening/closing a beverage control valve only). One or both valves 36, 37 may be controlled by a controller 34, i.e., control circuitry. For example, the controller 34 may detect when the device 1 is engaged with a container 700, e.g., by detecting that the needle has been inserted through a cork or a device 1 clamp is engaged with a container neck, and then control the valves accordingly. Where not controlled by a controller, the valves may be manually operable by a user, and/or a user may provide input to the controller 34 to cause the valves to open and/or close. As another option, operation of the valves may be tied together, whether mechanically or via electronic control, e.g., so that when one valve is opened, the other valve is closed, and vice versa, or so that when one valve is open the other valve is open as well (such as when using a two lumen needle).

Figure 2:
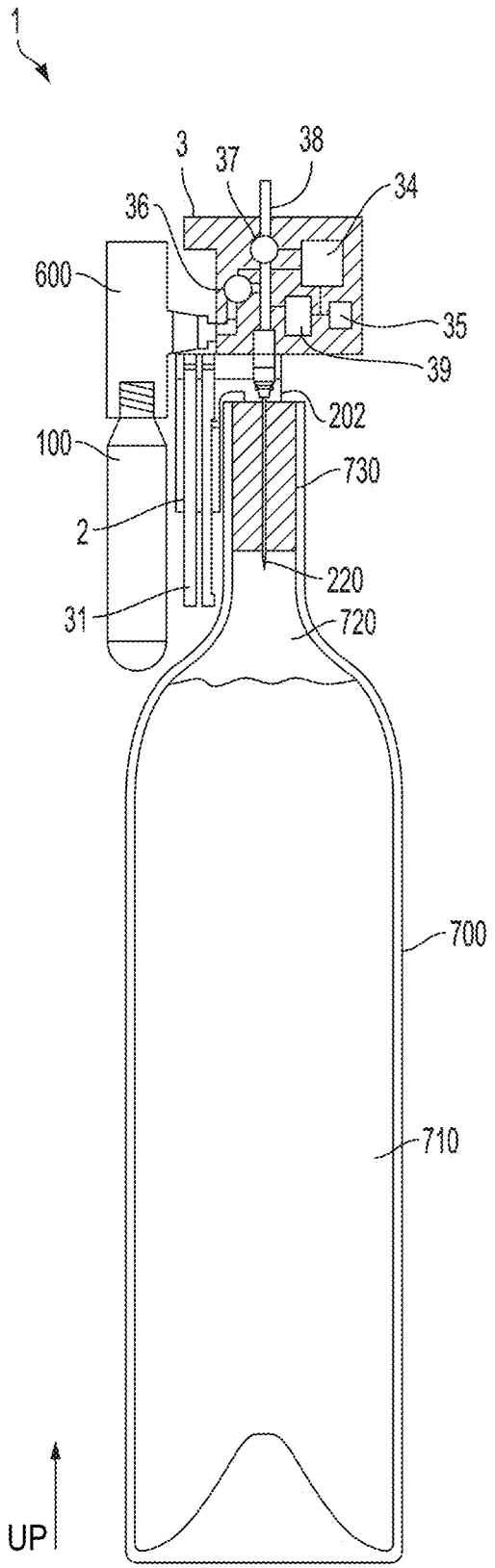
FIG. 2 shows the FIG. 1 embodiment with the conduit passed through the closure.
Figure 3:
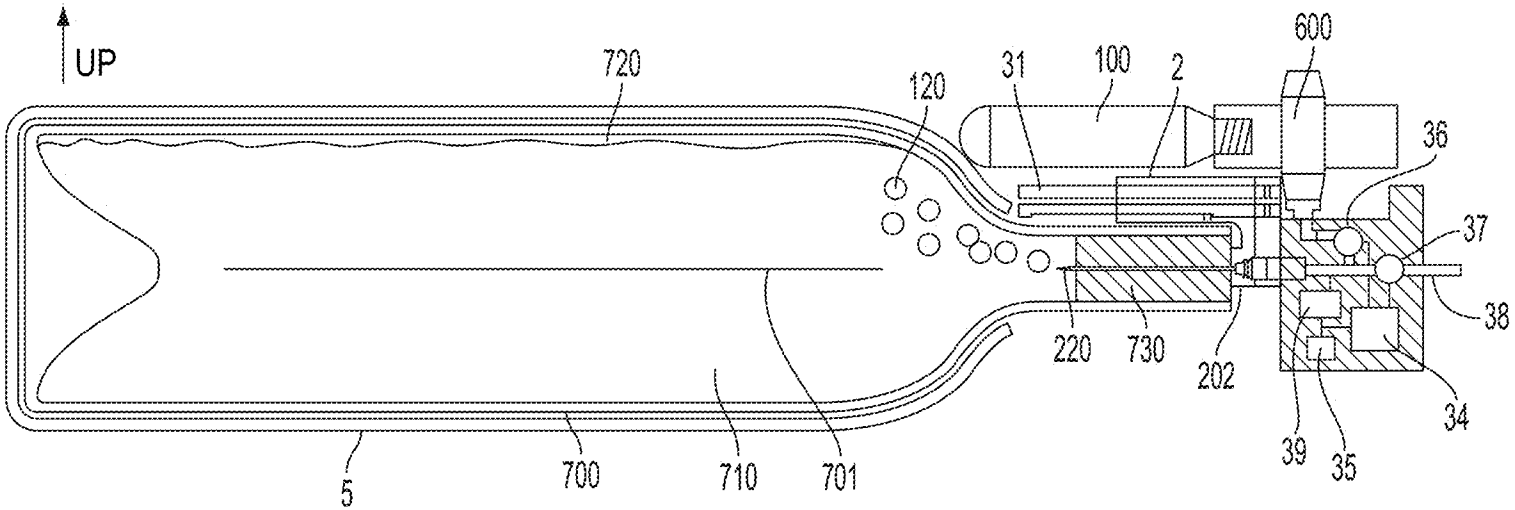
FIG. 3 shows the FIG. 1 embodiment while introducing gas into the bottle.
Figure 4:
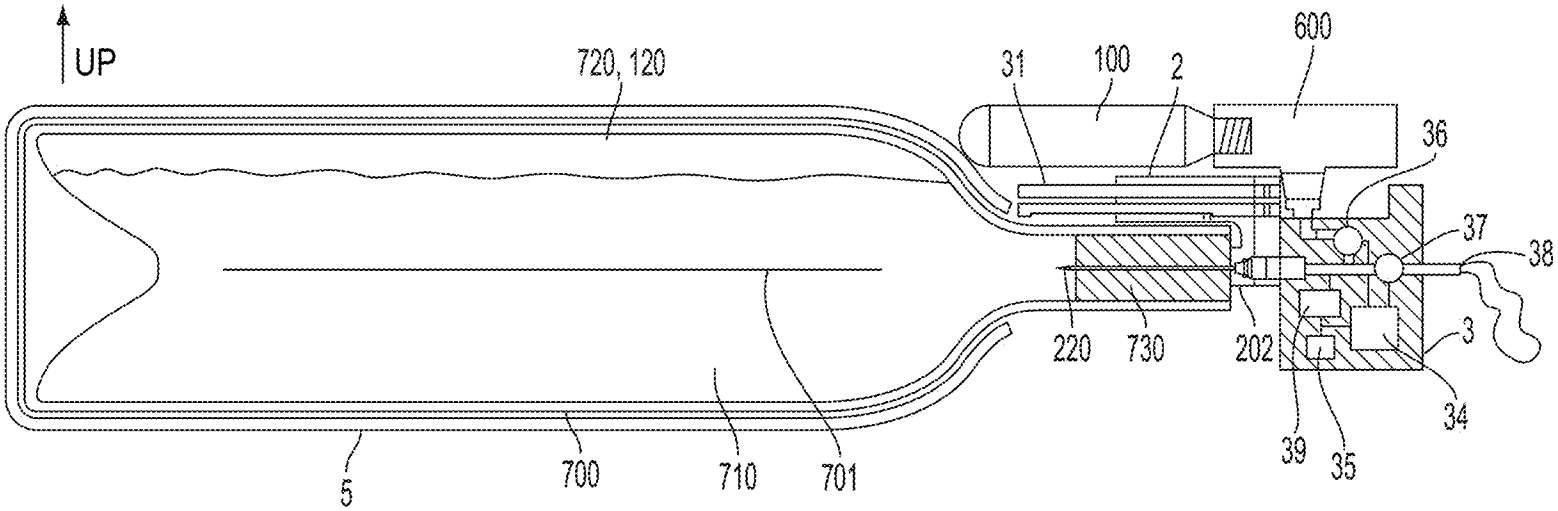
FIG. 4 shows the FIG. 1 embodiment while dispensing beverage from the bottle.

To introduce gas into the container 700 and extract beverage, at least one conduit is put in fluid communication with the interior of the container 700. In this embodiment, a needle 200 attached to the body 3 is inserted through a cork or other closure 730 that seals an opening at a neck of the container 700, as shown in FIG. 2. In this illustrative device 1, the needle 200 includes one or two lumens or conduits with a needle opening 220 along a sidewall of the needle near the needle tip. While the needle 200 may be inserted into and through the cork or other closure 730 in different ways, in this embodiment, the device 1 includes a base 2 (which may be secured to the container 700 by a clamp as discussed below) with a pair of channels 21 that receive and guide movement of respective rails 31 of the body 3. Thus, movement of the body 3 and attached needle 200 relative to the container closure 730 may be guided by the base 2, e.g., the body 3 may slide relative to the base 2 to move the needle 200 into/out of the closure 730. In addition, movement of the needle 200 may be guided by a needle guide 202 that is attached to the base 2 and positioned over the closure 730. To insert the needle 200 through the closure 730, a user may push downwardly on the body 3 while maintaining the base 2 and the container 700 at least somewhat stationary relative to each other. The needle 200 will pass through the closure 730, guided in its motion, at least in part, by the guided motion of the body 3 relative to the base 2 (e.g., by the rails 31 and channels 21). With the needle 200 suitably inserted as shown in FIG. 2, a needle opening 220 at the needle tip may be positioned below the closure 730 and within the enclosed space of the container 700. This allows fluid communication between the interior of the container 700 and one or more conduits of the needle 200.

Other arrangements for guiding movement of the body 3 relative to the base 2 are possible, such as providing one or more rails on the base 2 which engage with a channel or other receiver of the body 3, providing an elongated slot, channel or groove on the body or base which engages with a corresponding feature (e.g., a tab) on the other of the body or base and allows for sliding movement, a linkage that connects the body and base together and allows for movement of the body to insert the needle into the closure, and others.

In embodiments where a needle 200 includes one lumen or conduit, the valves 36, 37 may be controlled to alternately provide pressurized gas into the container 700 and allow beverage to flow from the container 700. For example, gas may first be introduced into the container 700 via the single conduit to establish a pressurized condition in the container 700, and then gas flow may be stopped and pressurized beverage may be permitted to flow out of the single conduit to the dispensing outlet. Where the needle 200 includes two lumens or conduits (or two or more needles are used), one or more conduits may be dedicated to gas flow into the container and one or more other conduits may be dedicated to beverage flow. Thus, the gas control valve 36 may control gas flow into the gas conduit(s), and the beverage control valve 37 may control beverage flow from the beverage conduit(s). Alternately, only one of the valves 36, 37 need be provided to control beverage flow, e.g., the gas control valve 36 may be opened/closed and beverage may flow out of the container and to the dispensing outlet 38 via a dedicated, always open beverage conduit depending on pressure in the container. It should be appreciated that use of a needle or other structure capable of penetrating a cork or other closure is not necessary. Instead, any suitable hose, pipe, tube or other conduit may be used instead of a needle, e.g., a cork may be removed and the conduits fluidly coupled to the container 700, e.g., by a plug or cap through which the conduit(s) extend.

In accordance with an aspect of the invention, the beverage extraction device may detect whether the container is in a pour or no-pour orientation, and automatically control portions of the device to dispense beverage while in the pour orientation, but not while in the no-pour orientation. For example, the device 1 may include an orientation sensor 35 constructed and arranged to detect a pour condition when a bottom of the container 700 is positioned above an opening of the container 700 (e.g., where a closure 730 is located). Alternately, the orientation sensor 35 may detect a pour condition when a longitudinal axis 701 of the container 700 is rotated about a horizontal axis by at least 90 degrees, or other movement of the container 700 that represents beverage is to be dispensed from the container 700. To detect such conditions, the orientation sensor 35 may include one or more gyroscopes, accelerometers, mercury or other switches, etc., arranged to detect motion and/or position of the device 1 and container 700 relative to gravity. In another embodiment, the orientation sensor 35 may detect a pour condition when beverage is in contact with a needle 200 or other conduit arranged to receive beverage. For example, the orientation sensor 35 may include a conductivity sensor, float switch or other arrangement to detect the presence of liquid beverage at the distal end of the needle 200 or other conduit that receives beverage.

These conditions, or others, detected by the orientation sensor 35 can be used by the controller 34 to determine that the user has manipulated the container 700 to dispense beverage from the container 700, i.e., the container is in a pour orientation. In response, the controller 34 can control one or more valves to dispense beverage from the container 700. For example, in the illustrative embodiment of FIG. 3, the controller 34 may detect that the container 700 has been rotated 90 degrees or more relative to an upward direction (i.e., a direction opposite to the direction of local gravitational force) and open the gas valve 36 to deliver pressurized gas into the container 700. Thereafter, the controller 34 may close the gas control valve 36 and open the beverage control valve 37 to allow beverage to be dispensed via the dispensing outlet 38. This configuration allows the device 1 to use a single lumen needle 200 to dispense beverage from the container. As will be understood, the controller 34 may cause beverage to be dispensed intermittently, e.g., by alternately opening the gas control valve 36/closing the beverage control valve 37 to deliver pressurized gas into the container 700 and closing the gas control valve 36/opening the beverage control valve 37 to dispense beverage from the container 700. Where the needle 200 or other element has two conduits, the controller 34 may simultaneously open the gas control and beverage control valves 36, 37 to dispense beverage. As noted above, beverage dispensing can be controlled in other ways depending on a number of conduits in fluid communication with the container 700 and/or a valve arrangement. For example, if a two-lumen needle 200 is employed, the device 1 may include only a gas control valve 36 or only a beverage control valve 37, which is opened to dispense beverage and closed to stop dispensing.

The controller 34 may continuously, periodically or otherwise monitor the orientation information from the orientation sensor 35 and control beverage dispensing accordingly. For example, if the orientation sensor 35 detects that the container 700 is no longer in a pour orientation, the controller 34 may stop beverage dispensing, such as by closing the gas and/or beverage control valves 36, 37. If the device 1 is again detected to be in a pour orientation, beverage dispensing may begin again.

In some embodiments, the controller 34 may control an amount or volume of beverage dispensed for each pouring operation, e.g., for each time the device 1 is detected to be in a pour orientation and remains in the pour orientation for an extended period such as 1 second or more. For example, the controller 34 may be configured to dispense a predetermined amount of beverage, such as 4 or 6 ounces/125 ml or 150 ml, for each pouring operation. In other arrangements, the controller 34 can receive user input to select one of two or more volume options, such as pouring a "taste" or relatively small amount, or pouring one or more larger volumes. Thus, the controller 34 may include a push button, voice control, or other user interface to receive selectable dispense volume information. Based on the selected pour volume, the controller 34 may control the operation of the valve(s) to dispense the selected amount. Note that controller 34 control of a dispense volume need not be coupled with an ability to detect whether a container is in a pour/no-pour orientation. Instead, a user may select a desired dispense volume and then press a button or other actuator to initiate dispensing. The controller 34 may stop dispensing when the selected volume has been dispensed, e.g., by closing a suitable valve.

The controller 34 can control how much beverage is dispensed in different ways. For example, the controller 34 may include a flow sensor arranged to detect an amount of beverage dispensed and control operation of the valve(s) based on information from the flow sensor. In another arrangement, the controller 34 may determine an amount of beverage dispensed based on a time that the beverage control valve 37 is open for dispensing. Where a pressure in the container 700 and/or other dispense conditions are known (e.g., a flow rate through a needle 200 may be relatively constant even for a relatively wide range of pressures in the container), a time-based control of beverage volume corresponding to an open time for the beverage control valve 37 may be sufficiently accurate. In another embodiment, the controller 34 may determine a flow rate from the container based on a pressure in the container 700, and thus may include a pressure sensor 39 to detect a value indicative of a pressure in the container 700. The pressure sensor 39 may have a sensor element positioned in the container (e.g., at an end of the needle 200), in a conduit between the gas source and the container, or in other suitable locations to provide an indication of pressure in the container 700. The pressure detected by the pressure sensor 39 may be used by the controller 34 to determine a flow rate of beverage from the container 700, and thus determine an amount of beverage dispensed (e.g., a flow rate of beverage out of the dispensing outlet 38 may be related to pressure in the container 700, and by multiplying the flow rate(s) by a dispense time, the dispense volume may be determined).

Information from the pressure sensor 39 may also be used by the controller 34 to control a pressure in the container 700 to be within a desired range. For example, the controller 34 may control pressure in the container 700 to be within a desired range to ensure that beverage is dispensed at a suitably high rate and/or at a known flow rate. In another arrangement, the controller 34 may control the pressure in the container 700 to be somewhat lower, e.g., to preserve gas provided from the gas source 100 and dispense at a slower flow rate. In some cases, a user may be able to set the device 1 to operate in different dispensing modes, such as "fast pour" or "save gas" modes in which the device 1 operates to dispense beverage at a maximum or other relatively high rate using a relatively higher pressure in the container 700 (a fast pour mode) or operates to dispense beverage in a way that uses as little dispensing gas as possible by using a relatively lower pressure in the container 700 (a save gas mode). Alternately, a user could interact with the controller 34 to adjust the dispense rate up or down. Again, the user could provide the dispense speed information by a user interface of the controller 34 or other means, and a selectable dispense rate feature may be used with or without dispense volume control, e.g., where the controller 34 dispenses a specified volume of beverage.

In another aspect of the invention, a dispensing device may be arranged to determine a volume of beverage remaining in a container, and in one embodiment the volume of beverage in the container may be determined based on a change in pressure over a time period that pressurized gas is delivered to the container. For example, the device 1 may include a source of pressurized gas 100 that is used to deliver gas into a container. The device 1 may measure a rate at which pressure increases in the container 700, and based on the pressure rate change determine an amount of beverage in the container. The pressure of gas provided to the container may be regulated, e.g., so that gas is provided at a relatively constant pressure to the container during the pressure rate change measurement. Pressure in the container may be measured, e.g., using a pressure sensor 39, and as will be understood, the rate change of pressure in the container will tend to be lower for containers having less beverage volume and larger gas volume inside the container. The controller 34 may store a look-up table of values that each correspond an amount of beverage remaining with a detected pressure rate change, or may use an algorithm that employs a pressure rate change to determine a remaining volume of beverage. In another embodiment, the controller 34 need not include a pressure sensor 39, and may instead provide gas to the container at a regulated pressure until a pressure in the container equalizes with the regulated pressure. The time over which the container takes to equalize pressure may be used by the controller 34 to determine a remaining beverage volume, e.g., by look up table, algorithm, etc. The controller 34 may prevent beverage dispensing during a time that the container is pressurized during volume remaining measurement, or may dispense beverage during a pressurization period used to determine a volume of beverage in the container. (Dispensing of beverage during volume remaining measurement need not be problematic to determining the volume remaining since the controller 34 may store information regarding a rate at which flow out of the container occurs, and/or the algorithm, look up table, or other means by which a remaining volume is determined may be arranged to account for dispensing.)

In another embodiment, the device 1 may be arranged to determine a volume of beverage remaining in a container based on a change in pressure in the container while beverage is being dispensed. For example, generally speaking, a container with a larger gas volume will experience a slower drop in pressure for a unit volume of beverage dispensed than a container with a smaller gas volume. This relationship may be used by the device 1 to determine a remaining beverage volume in a container during dispensing. For example, a source of pressurized gas 100 may be used to deliver gas into a container, either before or during beverage dispensing, and the device 1 may measure a rate at which pressure decreases in the container 700 during dispensing. Based on the pressure decrease rate, the controller 34 may determine an amount of beverage in the container. As in other embodiments, the pressure of gas provided to the container may be regulated, or may not be regulated. Pressure in the container may be measured, e.g., using a pressure sensor 39, as discussed above. To determine the remaining volume of beverage, the controller 34 may store a look-up table of values that each correspond an amount of beverage remaining with a detected pressure rate change, or may use an algorithm that employs a pressure rate change to determine a remaining volume of beverage. The determined amount of beverage remaining in the container 700 may be used to control gas delivery for dispensing, e.g., a container having a relatively small amount of remaining beverage may require a larger volume of gas for dispensing a given amount of beverage than a container that is more full. Thus, for example, the controller 34 may adjust gas valve 36 open times depending on a remaining amount of beverage in the container 700.

In some embodiments, a cross sectional size of one or more lumens in a needle or other conduit or other resistance to flow of the needle/conduit may influence gas and/or beverage flow through the needle or other conduit. In some cases, needles may be coded or otherwise identified so that a controller 34 can receive information regarding a restriction to flow of the needle. For example, needles or other conduits may have an identification number or other text, an RFID tag, a magnet indicator, or other arrangement that includes or represents information regarding flow restriction for the needle. A user may provide the identification number or other indicia to the controller 34 (e.g., by a user interface), or the controller 34 may read the indicia on the needle itself (e.g., in the case of an RFID tag or magnet indicator). The controller 34 may then use the flow restriction information to control gas and/or beverage dispensing.

Where the controller 34 determines an amount of remaining beverage and the device 1 is subsequently (or concurrently) used to dispense beverage, the controller 34 may adjust (reduce) the amount of remaining beverage by an amount of beverage dispensed. For example, the controller 34 may measure an amount of time that a beverage control valve 37 is open and use that information to determine an amount of beverage dispensed. The dispensed beverage may be used to reduce the remaining amount earlier determined to update the remaining amount. Where the controller 34 dispenses during a time that the controller 34 determines an amount of remaining beverage, the controller 34 may take dispensed beverage into account, e.g., an algorithm used to determine an amount of remaining beverage may take beverage dispensed during the measurement operation into account. Note also that the controller 34 may use an amount of dispensed beverage to determine an amount of beverage remaining in a container. For example, when the device 1 is associated with a container 700 that has never been accessed, the device 1 may assume that the container 700 initially has a starting volume of beverage (e.g., 750 ml of wine), and may subtract an amount of beverage dispensed from the starting volume to determine a remaining volume in the container.

The controller 34 may use the determined remaining beverage information in different ways. For example, containers may have identifying indicia, such as an RFID tag, bar code, alphanumeric text, etc., and the controller 34 may associate the remaining beverage information with each specific container. This way, the controller 34 may store the amount of beverage remaining for each of a plurality of containers, and when the device 1 is subsequently used with a previously used container, the controller 34 may display a remaining amount of beverage, such as on a visual display, by audibly announcing a remaining amount, etc. In another embodiment, the controller 34 may communicate a remaining amount of beverage to another device, such as a personal computer, server, smartphone or other device, whether by wireless or wired connection. As will be understood, a smartphone or other similar device may operate an application that enables communication with one or more devices 1, manages display of information and/or user input to the device 1, etc. The application may also manage communication between the device 1 and the smartphone, such as by Bluetooth or other wireless communication, so the devices may share information. This may allow a user to view on the smartphone or other device how much beverage is remaining, as well as other information such as a type of beverage in the container, how much gas is left in the gas source 100 or how much beverage can be dispensed with the remaining gas, a type of gas in the gas source 100 (e.g., argon, carbon dioxide, etc.), when a container was first accessed for dispensing, and/or a size of needle mounted on the device (needle size may be relevant for different container closures. For example, a smaller size needle may be desired for certain types of corks or other closures and/or to help ensure that the cork will reseal upon removal of the needle, whereas larger needles may be desired for faster dispense speeds).

The controller 34 may also use an ability to detect whether the device is mounted to a container and/or detect features of a container in a variety of ways. For example, the controller 34 may detect whether the device 1 is mounted to a container, e.g., by detecting that the needle has been inserted through a cork, by detecting an RFID tag, barcode or other indicia on a container, by detecting activation of a clamp or other container engagement feature of the device 1, etc., and in response initiate operation of the device 1. For example, if a sensor associated with a clamp of the device 1 indicates that the device 1 is secured to a container 700, the device 1 may start to monitor its orientation and/or an orientation of an attached container to control beverage dispensing, may display gas and/or beverage remaining values, and so on, after detecting that the device 1 is engaged with a container. Also, or alternately, other features regarding the container may be displayed, such as a type of beverage, a temperature of the beverage (where the device 1 is outfitted with a temperature sensor), an indication of when the container was last accessed by the device 1, suggestions for food pairing with the beverage, and so on. As noted above, information may be relayed from the device 1 to a user's smartphone or other device for display to the user, whether by visual indication, audible indication, etc. The device 1 may also use sensed information to access other information, e.g., stored remotely on a webserver, to provide additional information to a user. For example, a device 1 may be equipped with a temperature sensor to detect a temperature of the container itself and/or beverage in the container. Based on the temperature information, and possibly a type of beverage, the device 1 may access stored information to determine if the beverage is within a desired temperature range for suitable serving. If not, the device 1 may indicate the beverage temperature with information regarding optimal serving temperatures.

In some embodiments, the controller 34 may be arranged to determine and track an amount of gas in the gas source, such as a compressed gas cylinder. Such information may be useful, e.g., to alert a user that a gas source is about to run out. For example, in one embodiment the controller may have a pressure sensor 39 arranged to detect a pressure of gas in the gas cylinder 100, and use the detected pressure to determine how much gas remains in the cylinder. This information may be used by the controller 34 to provide information to a user that the cylinder 100 should be replaced, a warning that the cylinder may run out soon, etc. In another embodiment, the controller 34 may determine a pressure in the gas cylinder or other value indicative of an amount of gas left in the cylinder based on an amount of time that a gas control valve 36 or beverage dispense valve 37 is open to cause gas delivery into the container. For example, where a regulator 600 is provided, the controller 34 may store information that represents a total time that the gas source 100 can deliver gas at the regulated pressure. When a gas cylinder or other source 100 is replaced, the controller 34 may detect the replacement and then track a total time that gas is delivered from the gas source 100, e.g., based on how long a gas control valve is open. The total delivery time may be used to indicate an amount of gas left in the source 100, e.g., ¾ full, ½ full, etc., and/or indicate when the source 100 is about to run out. The controller 34 may also refuse to perform a dispensing operation where the gas source 100 does not have sufficient gas to perform the operation. In other arrangements, the controller 34 may determine an amount of gas remaining in a gas source 100 based on how much beverage is dispensed. As discussed above, the controller 34 may determine how much beverage is dispensed from one or more containers, and determine an amount of gas remaining in a gas source 100 based on how much total beverage has been dispensed using the gas source 100. For example, the controller 34 may store information regarding a total number of ounces or other volume measurement a gas source 100 can be used to dispense, and the controller 34 may display an amount of gas remaining that corresponds to the amount of beverage dispensed.

In some embodiments, the controller 34 may detect a gas source 100 and determine characteristics of the gas source 100 for use in operation of the dispensing device 1. For example, the controller 34 may detect an RFID tag, barcode, color tag, or other indicia on a gas source 100 (such as a gas cylinder) an identify a variety of different characteristics of the gas source 100 based on the indicia, such as a type of gas in the source 100, an amount of gas in the source 100, an amount of beverage that may be dispensed using the source 100, an initial pressure of gas in the source 100, etc. The controller 34 may adjust operation of the device 1 based on the type of gas source or other characteristics. For example, if the controller 34 detects that the gas source 100 has a relatively low initial pressure, the controller 34 may select a smaller total beverage volume that can be dispensed using the gas source 100 as compared to a higher pressure gas source. This may allow the controller 34 to more accurately indicate how much gas is remaining in the source 100 over time, i.e., as beverage is dispensed.

In yet another embodiment, the controller 34 may detect when a gas source 100 is nearing an empty state without monitoring how much gas is used from a gas source. In some cases, such as when a single stage regulator 600 is used with a gas source 100, a dispense pressure from the regulator will rise above a normal setting as the gas source 100 is running low. (It is believed that the rise in pressure is due to the relatively low pressure in the gas source 100 being insufficient to cause the regulator valve to close as rapidly as normal.) The controller 34 may detect this rise in pressure using a sensor, such as the pressure sensor 39, and provide an indication that the source 100 is about to run out, stop dispensing operation, or take other suitable action.

In another aspect of the invention, the device 1 may be arranged to stop beverage dispensing while in a pour orientation. For example, the orientation sensor may detect rotation of the container about a longitudinal axis of the container while in a pour orientation and in response the controller 34 may stop dispensing of beverage. That is, similar to the way a person may rotate a wine bottle about its longitudinal axis when stopping pouring of wine into a glass, the device 1 may detect similar rotation of a container and stop dispensing, even if the container remains in a pour orientation. Rotation of the container about the longitudinal axis in an opposite direction while the container is in a pour orientation may be sensed and the controller 34 may resume dispensing. Alternately, the controller 34 may not again begin dispensing until the container is put in a no-pour orientation and then a pour orientation. Note that this aspect of the invention may be combined with an auto-pour feature discussed above where the device 1 senses a container is in a pour orientation and begins beverage dispensing, or may be used independently. For example, the device 1 may be arranged to begin dispensing in response to a user's command, such as pressing a button, and may stop dispensing in response to detecting rotation of the container about its longitudinal axis. Sensing of rotation of the container 700 about its longitudinal axis may be performed by the same or similar sensors discussed above for detecting whether the container is in a pour orientation, e.g., accelerometers, gyroscopes, mercury or other switches, etc.

Figure 5:
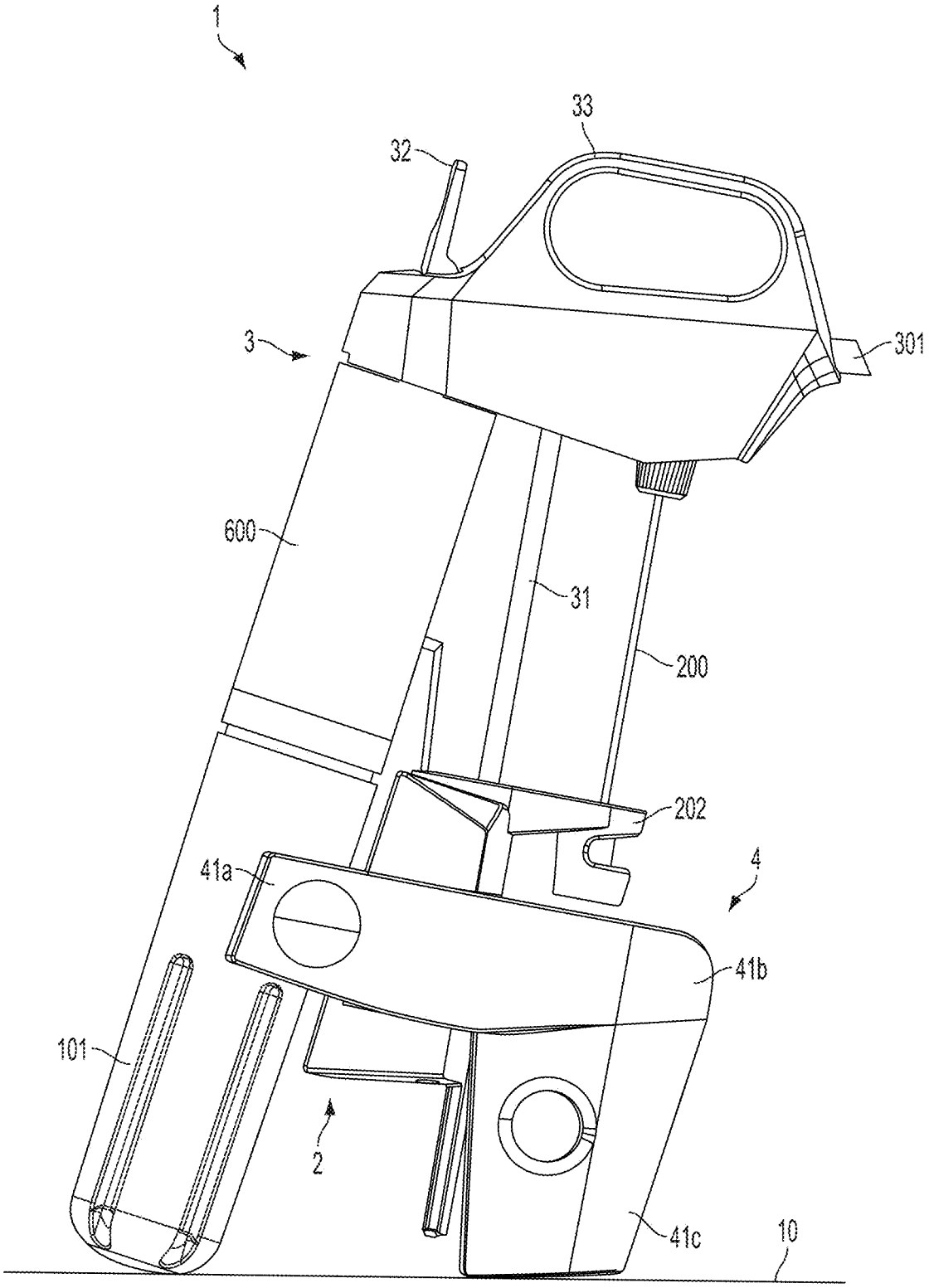
FIG. 5 shows a perspective side view of a beverage extraction device in an illustrative embodiment.
Figure 6:
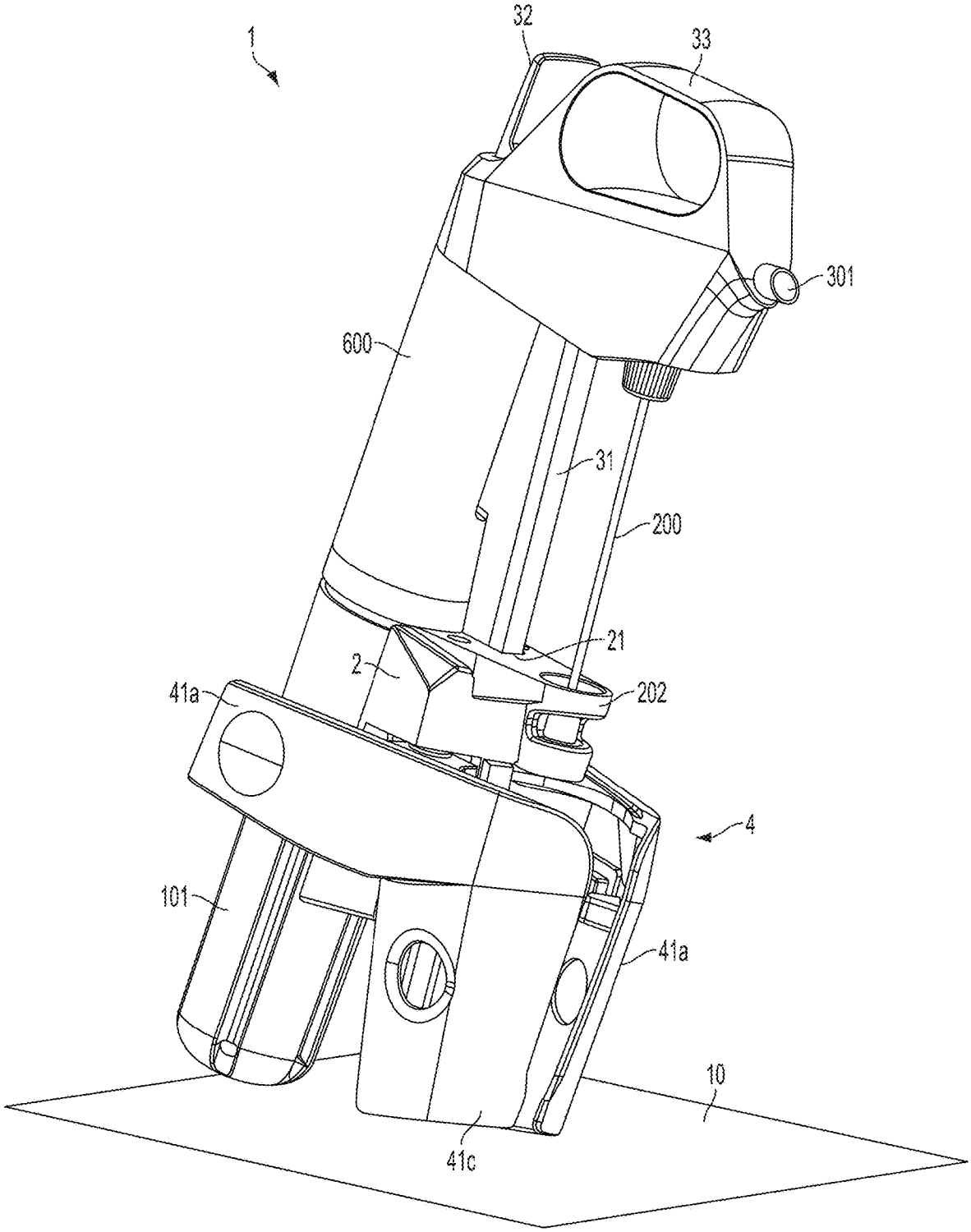
FIG. 6 shows a perspective view of the extraction device of FIG. 5.

As will be appreciated, a beverage extraction device may benefit from a clamp or other arrangement configured to engage the device with a bottle, e.g., by clamping the device to the neck of a bottle. For example, the device can include one or more clamp arms that are movably mounted to the device and are arranged to engage with a bottle to support the device on the bottle during use. The embodiment of FIGS. 5 and 6 has a clamp 4 having a pair of clamp arms 41 that are optionally arranged to support the device 1 in an upright orientation on a flat, horizontal surface 10, such as a table or counter top. (It should be appreciated, however, that a single clamp arm may be provided instead of a pair, as described in more detail below.) In this embodiment, the clamp arms 41 each include a downwardly extending portion 41*c* that contacts the surface 10 along with a lowermost portion of the body 3, which in this example is a lower end of gas cylinder cover 101.

The clamp arm(s) may also include a feature to help properly engage the clamp arm(s) with a variety of different bottle necks. For example, different bottles may have different neck diameters, different lip diameters or lengths (as used herein, a lip is a feature of many wine bottles near the top of the neck in which the bottle flares, steps or otherwise protrudes outwardly in size). In one embodiment, the clamp arm(s) include a distal tab feature and a proximal ridge feature that cooperate to properly engage with different neck configurations. FIGS. 5-8 show one illustrative embodiment in which each clamp arm 41 includes a distal tab 43 and a proximal ridge 44. The tab 43 may extend radially inwardly somewhat more than the ridge 44, and thus help to center the bottle neck or otherwise appropriately position the neck relative to the clamp arms 41. For example, as the clamp arms 41 are closed on a neck, the tabs 43 may contact the neck before the ridges 44, helping to center or otherwise appropriately position the neck relative to the device 1. In some embodiments, the tabs 43 and/or the ridges 44 may have portions that contact the bottle neck have a relatively hard, low-friction surface to help allow the clamp arms 41 engage the neck while allowing the neck to shift in position relative to the clamp arms 41. The tabs 43 may help urge the neck proximally relative to the base 2, e.g., to move the neck toward a pad 22 located on the base 2 between the clamp arms 41. By urging the neck to move proximally and into contact with the pad 22 or other component, the clamp arms 41 may help position the neck in a consistent way relative to the needle guide 202 and the needle 200. This may help ensure that the needle 200 penetrates the closure 730 in a desired location. For example, with the neck positioned in contact with the pad 22, the needle guide 202 and needle 200 may be arranged to pierce a closure 730 in a location that is offset from a center of the closure 730. This may help avoid having the needle 200 penetrate the closure in the same location if the device 1 is used two or more times to extract beverage from the bottle 700. (As noted above, beverage can be extracted without removal of the closure 730, and since the closure can reseal after removal of the needle, beverage can be extracted multiple times from a bottle 700 without removal of the closure 730, although the closure 730 may be pierced several times to do so.) Alternately, the needle 200 and guide 202 may be configured to penetrate a closure at its center with the neck in contact with the pad 22, and by positioning the neck proximally and in contact with the pad 22, the closure 730 may be penetrated at the center as desired. In another arrangement in which the device is arranged to penetrate the closure 730 at a center position, the clamp arms 41 may each include semi-circular or other suitably arranged surfaces that contact the neck so the center of the closure 730 is always positioned for penetration by the needle 200.

Figure 7:
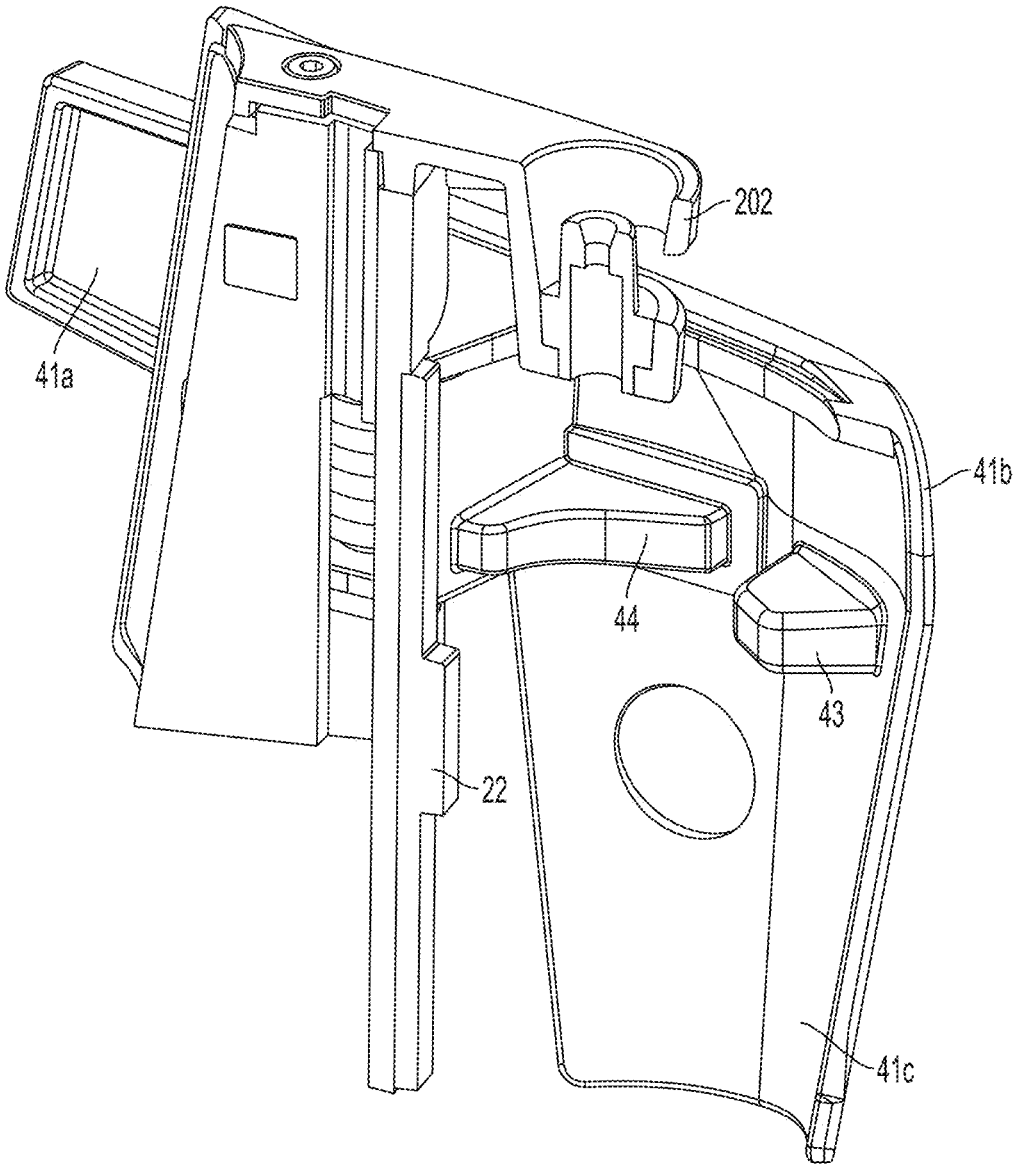
FIG. 7 shows a side view of an inner surface of a clamp arm of the FIG. 5 embodiment.

The ridge 44, though optional, may have a length measured in a direction perpendicular to a bottle neck (or in a direction perpendicular to the length of the needle 200) that is greater than the tab 43, e.g., to help the ridge 43 provide a suitably long contact surface for the lip of the bottle. For example, while the tabs 43 may help center the neck between the clamp arms 41 and urge the neck to move proximally, the ridges 43 may contact an underside of the bottle lip with a suitably long surface to help prevent the neck from moving downwardly relative to the clamp arms 41 more than a desired distance. The extended length of the ridges 44 may provide the ridges 44 with greater strength and help the clamp arms operate with a wide array of bottle neck and lip sizes and shapes. In addition, the ridges 44 may have a variable radial length, e.g., increasing proximally as shown in FIG. 7, to help ensure that the ridges 44 will provide suitable engagement with a variety of different necks having different lip dimensions.

The pad 22 in this illustrative embodiment includes a strip of resilient material, such as a rubber, that can help the device grip the bottle neck when engaged by the clamp arms 41. In some embodiments, the pad 22 may include a protrusion or step near a lower portion of the pad 22 (see FIGS. 7 and 8) so that the pad 22 can engage with a lower surface of a lip on a bottle neck, e.g., similarly to the ridge 44. The pad 22 may extend in a direction along the length of the needle, i.e., along a length of the bottle neck, and may have any suitable length. Generally, however, the pad 22 will have a length that is equal to or shorter than a length of the shortest bottle necks to be engaged by the device 1. Similar is true of the clamp arms 41. That is, the clamp arms 41 may have distal portions 41*b* that extend downwardly, in a direction along the length of the needle 200, to an extent that allows the clamp arms 41 to receive and engage bottles that have a somewhat short neck. In one embodiment, the distal portions 41*b* of the clamp arms 41 may extend downwardly at least to an extent equal to or greater than a lowermost position of the distal end of the needle 200 when the body 3 is positioned at a lowermost position relative to the base 2. In this way, the needle 200 may be prevented from contacting a surface 10 when the device is standing upright on the surface 10. Also, the needle 200 may be movable relative to the clamp arms 41 to be positioned within a space between the clamp arms 41 throughout its full range of movement.

In this embodiment, the device 1 includes a detent that resiliently holds the body 3 in an upper position relative to the base 2, e.g., to help ensure that the body 3 does not move relative to the base 2 while at rest on a counter top. For example, the detent may include a spring-loaded ball or other element mounted on the base 2 that engages with a suitable groove on the body 3 to hold the body 3 and base 2 stationary relative to each other until suitable force is exerted to overcome the detent holding function. (See, for example, FIG. 8 which show a detent 23 that includes a spring loaded plunger mounted to the base 2 that is arranged to engage with a groove or other feature on the rail 31 of the body 3.) Other detent arrangements are possible, such as a spring-loaded tab and slot, and others as will be appreciated by those of skill in the art. Moreover, a detent is not required to releasably hold the body 3 and base 2 in one or more positions relative to each other. For example, a friction element (such as a rubber strip positioned between the rail 31 and channel 21) may be included to provide a friction force that maintains the body and base stationary in the absence of a force over a threshold level. The friction element may provide the friction force for specific body/base positions, or throughout the full range of body/base movement. Other configurations are possible to help hold the body 3 and base 2 in one or more positions relative to each other, such as a spring-loaded pin, latch or other lock, a thumbscrew on the base 2 that can be tightened to engage the rail 31 and prevent body/base movement, etc.

Figure 8:
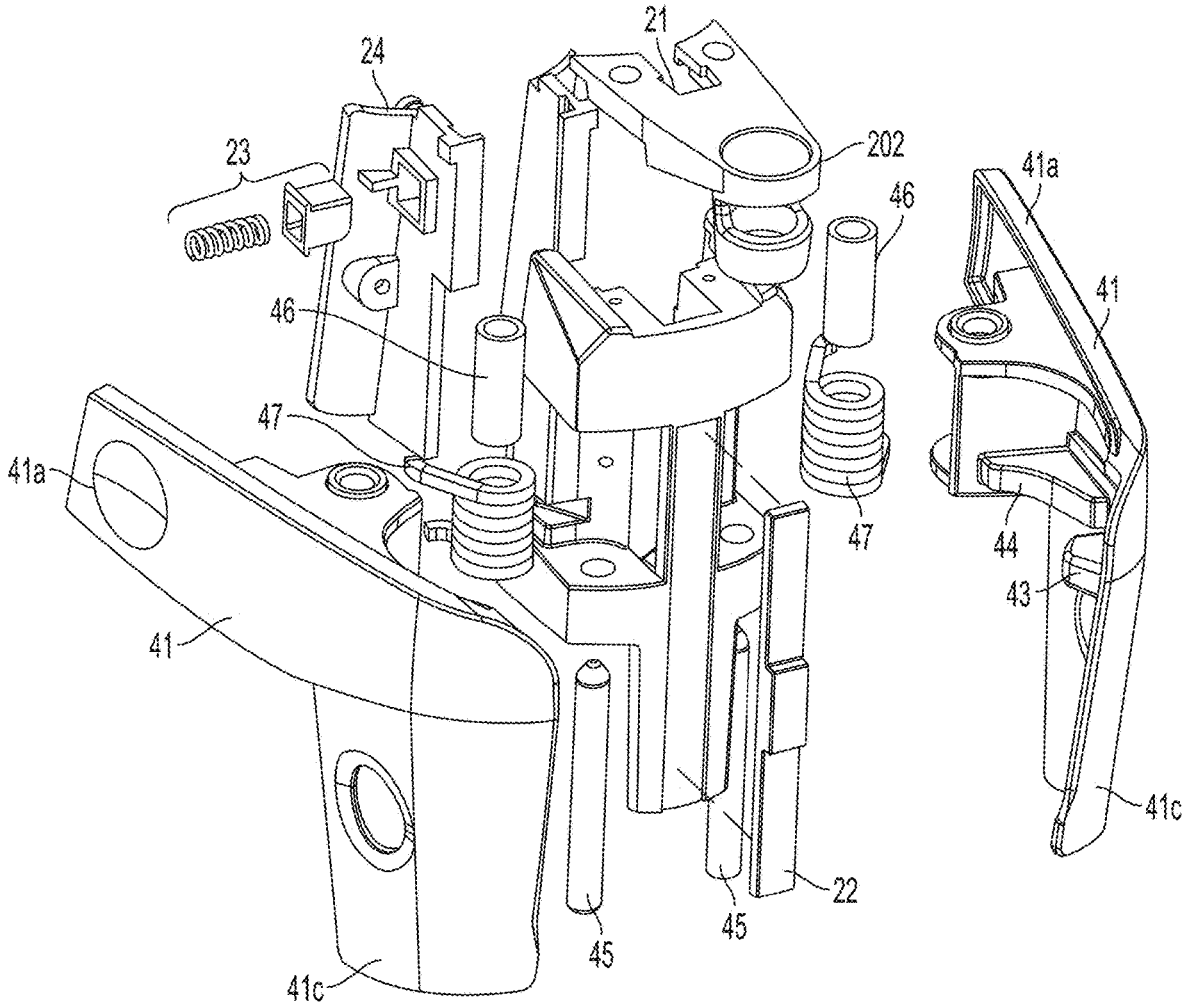
FIG. 8 shows an exploded view of the base in the FIG. 5 embodiment.

In this illustrative embodiment, the clamp arms 41 are pivotally mounted to the base 2 such that the distal portions 41*b* are normally biased to move toward each other, e.g., to clamp a bottle neck positioned between the arms 41. For example, as shown in FIG. 8, the clamp arms 41 are mounted to the base 2 via pivot pins 45 and bushings 46. However, the clamp arms 41 may be movably mounted relative to the base 2 in other ways, such as by a linkage, living hinge, a sliding engagement (such as by having a portion of a clamp arm move in a channel of the base), and others. Also, one arm may be fixed to the base while the other is made movable (although in this embodiment the arms are still said to be moveable relative to each other). Torsion or other springs may be used to provide the biasing force (if provided at all) on the clamp arms 41. For example, in this embodiment, torsion springs 47 are mounted over the bushings 46 and are arranged to engage the base 2 and a clamp arm 41 so that the clamp arms are biased to move the distal portions 41*b* toward each other. This clamping force of the clamp arms 41 may be sufficiently robust to support the device 1 on the bottle 700, or even to allow a user to lift and pour beverage from the bottle 700 by grasping and manipulating the device 1. The clamp arms 41 may also include proximal portions 41*a* that can be grasped by a user and moved together (overcoming the biasing force of the springs 47) so that the distal portions 41*b* are moved away from each other to receive a bottle neck. For example, in this embodiment, a user may pinch the proximal portions 41*a* together to position a bottle neck between the distal portions 41*b*, and then release the proximal portions 41*a* to allow the clamp arms 41 to clamp the bottle neck. However, other arrangements are possible. For example, the distal portions 41*b* may instead be biased to move away from each other and move toward each other when a user applies suitable force, e.g., to the distal portions 41*b*, to overcome the biasing force. In another embodiment, the clamp arms 41 need not be spring biased at all. In such arrangements where the clamp arms 41 are biased to move the distal portions 41*b* apart or are not biased at all, a locking mechanism may be used to engage the clamp arms 41 to the bottle.

That is, whether the clamp arms 41 are spring biased or not, movement of the arms may be restricted or otherwise controlled in some way by a locking mechanism. For example, the arms 41 may be secured together by a ratchet and pawl mechanism that allows the distal portions 41*b* of the clamp arms 41 to move freely toward each other, but prevents movement of the distal portions 41*b* away from each other unless the pawl is first cleared from the ratchet. This arrangement may allow a user to securely clamp the arms 41 onto a bottle neck with the ratchet and pawl ensuring that the arms 41 will not move away from each other to release the neck until the user releases the pawl. In other embodiments, the arms 41 may be secured against movement away from each other in alternate ways, such as by a buckle and strap (with the strap secured to one arm 41 and the buckle secured to the other arm 41), a screw and nut (in which the screw engages one arm 41, the nut engages the other arm 41, and the screw and nut threadedly engage each other to secure the arms 41 together), a hook-and-loop closure element that spans across the arms 41 at their distal end, or other arrangement suited to engage the arms 41 with the bottle 700.

Figure 9:
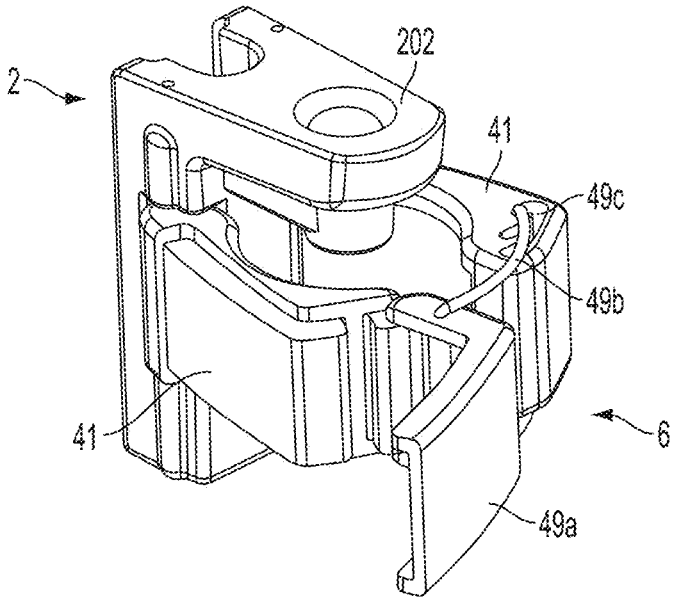
FIG. 9 shows a perspective view of a locking mechanism for a clamp in an illustrative embodiment in an open condition.
Figure 10:
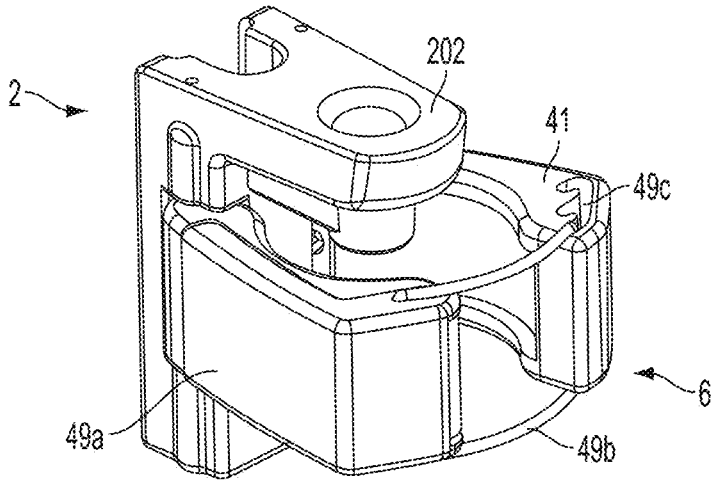
FIG. 10 shows the FIG. 9 embodiment with the clamp in a closed condition.

For example, FIGS. 9 and 10 show an illustrative embodiment in which the clamp arms 41 include a locking mechanism 6 in the form of a buckle similar to that found in some ski boots. In this embodiment, the locking mechanism 6 includes a handle 49*a* that is pivotally mounted to a clamp arm 41 and carries a bail 49*b*. The bail 49*b* is arranged to selectively engage with one of the bail-engaging slots 49*c* formed in the other clamp arm 41. Accordingly, the locking mechanism 6 in this embodiment is arranged to provide three different positions of the bail 49*b* on the bail-engaging slots 49*c*, thus allowing the locking mechanism to provide three different adjustment positions for engaging different sized bottle necks. To engage the clamp arms 41 to a neck, the bail 49*b* is engaged with a suitable slot 49*c*, and the handle 49*a* is rotated to lock the clamp arms 41 is place. Of course, other locking mechanisms are possible. Thus, the clamp 4 may include a locking mechanism that has a single locking position, multiple locking positions, a continuously variable locking position, a series of indexed or stepped locking positions, and/or a user defined locking position. Such clamp arm securing arrangements may be used whether the distal portions 41*b* of the clamp arms 41 are biased to move toward each other, away from each other, or with no bias at all.

Figure 11:
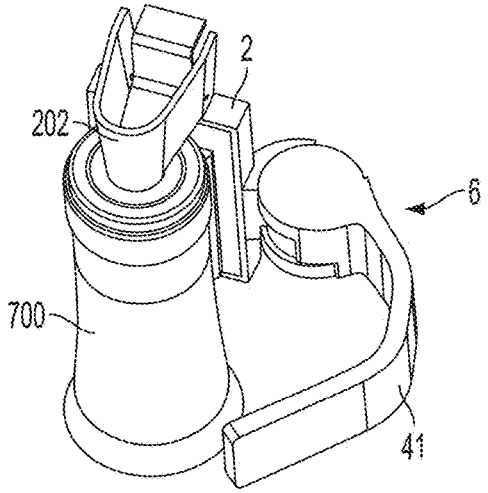
FIG. 11 shows an illustrative embodiment of a clamp arrangement having a single clamp arm.
Figure 12:
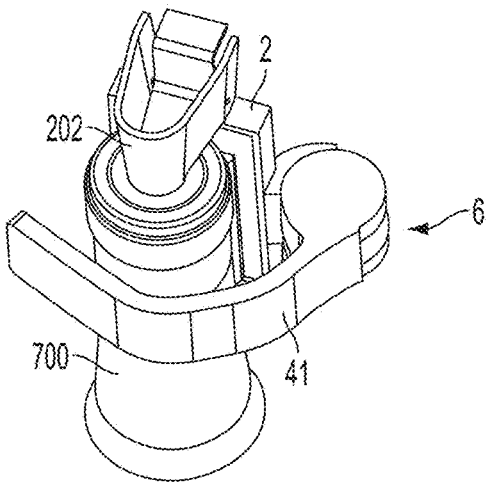
FIG. 12 shows the FIG. 11 embodiment with the clamp arm in the closed position.
Figure 13:
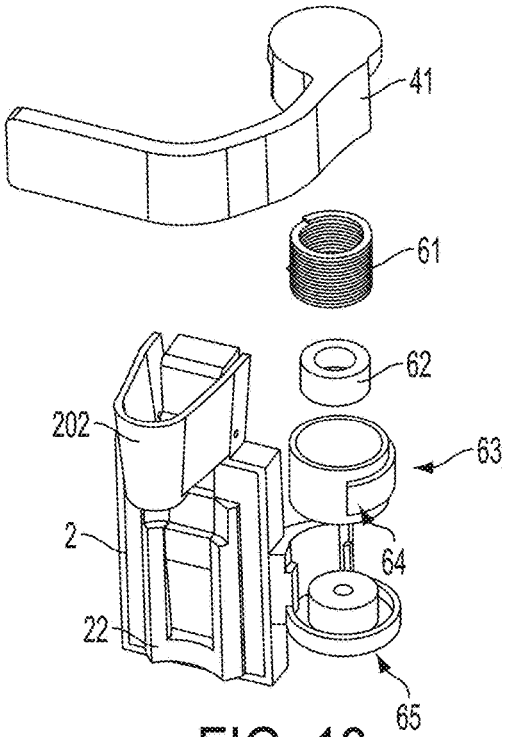
FIG. 13 shows an exploded view of a locking mechanism used with the FIG. 11 embodiment.

FIGS. 11-13 show another embodiment of a bottle clamp arrangement that includes a single clamp arm and that optionally can be configured to engage a bottle neck so that the closure is penetrated at an off-center position. (It should be appreciated, however, that the FIGS. 11-13 clamp arrangement could be used in a device that penetrates the closure at a center position as well.) In this embodiment, the clamp arrangement includes a single clamp arm 41 that is pivotally mounted to the base 2. A locking mechanism 6 is arranged to permit a user to freely move the clamp arm 41 from an open position (shown in FIG. 11) toward a closed position (shown in FIG. 12), but resists movement of the arm 41 from a closed position toward an open position. As a result, the device 1 can be associated with a bottle neck as in FIG. 11, and the clamp arm 41 moved to engage the neck as in FIG. 12 so that the device 1 is supported on the bottle. With the clamp arm 41 engaging the neck in a closed or clamping position, the arm 41 cannot be moved toward an open position unless the locking mechanism 6 is released. Thus, the device 1 may be engaged with the bottle and remain engaged with the bottle until a user releases the clamp arm 41. The clamp arm 41 and/or the pad 22 (see FIG. 13) may be arranged so that the neck is engaged to position a center of the closure 730 away from a penetration point of the needle 200, and thus ensure off-center penetration. For example, the pad 22 may have a semi-circular surface that contacts a bottle neck so as to offset the center of the closure 730 from a penetration point of the needle 200.

While the locking mechanism 6 may be arranged in other ways, in this embodiment the locking mechanism 6 includes a clutch spring 61 that is fitted over, and is engageable with an upper binding post 62 that is fixed to the clamp arm 41 and a lower binding post 65 that is fixed to the base 2. As will be understood by those of skill in the art, the clutch spring 61 may engage the binding posts 62, 65 so as to allow movement of the clamp arm 41 in a clockwise direction (as viewed from above) relative to the lower binding post 65, yet resist counterclockwise movement. A sleeve 63 may house the clutch spring 61 and a release tab 64 may be movable by a user to release the clutch spring 61 from the upper binding post 62 so as to allow the clamp arm 41 to move in the counterclockwise direction. Another spring (not shown) may be used to bias the clamp arm 41 to move toward the open position, e.g., so that the arm 41 moves under the spring bias to the open position when the release tab 64 is activated. Other arrangements for the locking mechanism are possible, such as ratchet and pawl configurations, rotary detents, etc.

As noted above, a sensor may be associated with a clamp arrangement to sense and indicate that the device 1 is engaged with a container. For example, a switch may be closed when the clamp is engaged with a container neck, indicating that the device 1 is engaged with a container. The controller 34 may use this information to control dispensing, e.g., the controller 34 may in response begin monitoring whether the container is in a pour orientation or not and control dispensing accordingly.

It has been found that needles having a smooth walled exterior, pencil point or Huber point needle of 16 gauge or higher are effective to penetrate through a wine bottle cork or other closure, while sealing effectively with the cork to prevent the ingress or egress of gases or fluids during beverage extraction. Moreover, such needles allow the cork to reseal after withdrawal of the needle, allowing the bottle and any remaining beverage to be stored for months or years without abnormal alteration of the beverage flavor. Further, such needles may be used to penetrate a foil cover or other wrapping commonly found on wine bottles and other bottles. Thus, the needle may penetrate the foil cover or other element as well as the closure, eliminating any need to remove the foil or other wrapping prior to beverage extraction. Other needle profiles and gauges are also usable with the system.

While in the above embodiments the needle guide 202 and needle are positioned to have the needle penetrate the center of the closure 730, the lower opening or through hole of the guide 202 could be arranged to introduce the needle at a location offset from the center of cork 730. This may decrease the chances that a needle penetrates the closure 730 in a same location if the system 1 is used to dispense beverage from the bottle several times and may allow the closure 730 to better reseal upon needle withdrawal.

While in the above embodiments, a user moves the body 3 in a linear fashion relative to the base 2 to insert/remove a needle with respect to a bottle closure, a manual or powered drive mechanism may be used to move a needle relative to a closure. For example, a rail 31 may include a toothed rack, while the base 2 may include a powered pinion gear that engages the rack and serves to move the body 3 relative to the base 2. The pinion may be powered by a user-operated handle, a motor, or other suitable arrangement. In another embodiment, the needle may be moved by a pneumatic or hydraulic piston/cylinder, e.g., which is powered by pressure from the gas cylinder 100 or other source.

A needle used in a beverage extraction device may be a smooth exterior walled, cylindrical needle with a non-coring tip that can be passed through a cork without removing material from the cork. One non-coring tip is a pencil-tip that dilates a passageway through the cork, although deflected-tip and stylet needles have also been found to work properly and could be used in alternative embodiments. The pencil-tip needle preferably has at least one lumen extending along its length from at least one inlet on the end opposite the pencil-tip and at least one outlet proximal to the pencil-tip. As shown above, a needle outlet may be positioned in the side-wall of the needle at the distal end of the needle, although proximal of the extreme needle tip.

With the correct needle gauge, it has been found that a passageway (if any) that remains following removal of the needle from a cork self-seals against egress or ingress of fluids and/or gasses under normal storage conditions. Thus, a needle may be inserted through a closure to extract beverage, and then be removed, allowing the closure to reseal such that beverage and gas passage through the closure is prevented. While multiple needle gauges can work, preferred needle gauges range from 16 to 22 gauge, with an optimal needle gauge in some embodiments being between 17 and 20 gauge. These needles gauges may offer optimal fluid flow with minimal pressures inside the bottle while doing an acceptably low level of damage to the cork even after repeated insertions and extractions.

Multiple needle lengths can be adapted to work properly in various embodiments, but it has been found that a minimum needle length of about 1.5 inches is generally required to pass through standard wine bottle corks. Needles as long as 9 inches could be employed, but the optimal range of length for some embodiments has been found to be between 2 and 2.6 inches. (Needle length is the length of a needle that is operable to penetrate a closure and/or contact a needle guide for guidance in moving through the closure.) The needle may be fluidly connected to the valve directly through any standard fitting (e.g. NPT, RPT, Leur, quick-connect or standard thread) or alternatively may be connected to the valve through an intervening element such as a flexible or rigid tube. When two or more needles are used, the needle lengths may be the same or different and vary from 0.25 inches to 10 inches. Creating distance between the inlet/outlets of the needles can prevent the formation of bubbles.

In some embodiments, a suitable gas pressure is introduced into a bottle to extract beverage from the bottle. For example, with some wine bottles, it has been found that a maximum pressure of between around 40 and 50 psi may be introduced into the bottle without risking leakage at, or ejection of, the cork, although pressures of between around 15 and 30 psi have been found to work well. These pressures are well tolerated by even the weakest of cork-to-bottle seals at the bottle opening without causing cork dislodging or passage of liquid or gas by the cork, and provide for relatively fast beverage extraction. The lower pressure limit in the bottle during wine extraction for some embodiments has been found to be between about 0 and 20 psi. That is, a pressure between about 0 and 20 psi has been found needed in a bottle to provide a suitably fast extraction of beverage from the bottle. In one example using a single 17 to 20 gauge needle, a pressure of 30 psi was used to establish an initial pressure in a wine bottle, and rapid wine extraction was experienced even as the internal pressure dropped to about 15-20 psi.

The source of pressurized gas can be any of a variety of regulated or unregulated pressurized gas bottles filled with any of a variety of non-reactive gasses. In a preferred embodiment, the gas cylinder contains gas at an initial pressure of about 2000-3000 psi. This pressure has been found to allow the use of a single relatively small compressed gas cylinder (e.g., about 3 inches in length and 0.75 inches in diameter) for the complete extraction of the contents of several bottles of wine. Multiple gasses have been tested successfully over extended storage periods, and preferably the gas used is non-reactive with the beverage within the bottle, such as wine, and can serve to protect the beverage oxidation or other damage. Suitable gases include nitrogen, carbon dioxide, argon, helium, neon and others. Mixtures of gas are also possible. For example, a mixture of argon and another lighter gas could blanket wine or other beverage in argon while the lighter gas could occupy volume within the bottle and perhaps reduce the overall cost of the gas.

The embodiments above, a single needle with a single lumen is used to introduce gas into the bottle and extract beverage from the bottle. However, in other embodiments two or more needles may be used, e.g., one needle for gas delivery and one needle for beverage extraction. In such an embodiment, the valve(s) may operate to simultaneously open a flow of gas to the bottle and open a flow of beverage from the bottle. The needles may have the same or different diameters or the same or different length varying from 0.25 to 10 inches. For example, one needle delivering gas could be longer than another that extracts wine from the bottle. Alternately, a two lumen needle may be employed where gas travels in one lumen and beverage travels in the other. Each lumen could have a separate entrance and exit, and the exits could be spaced from each other within the bottle to prevent circulation of gas.

Control of the system may be performed by any suitable control circuitry of the controller 34, which may include a programmed general purpose computer and/or other data processing device along with suitable software or other operating instructions, one or more memories (including non-transient storage media that may store software and/or other operating instructions), a power supply for the control circuitry and/or other system components, temperature and liquid level sensors, pressure sensors, RFID interrogation devices or other machine readable indicia readers (such as those used to read and recognize alphanumeric text, barcodes, security inks, etc.), input/output interfaces (e.g., such as the user interface to display information to a user and/or receive input from a user), communication buses or other links, a display, switches, relays, triacs, motors, mechanical linkages and/or actuators, or other components necessary to perform desired input/output or other functions.

While aspects of the invention have been shown and described with reference to illustrative embodiments, it will be understood by those skilled in the art that various changes in form and details may be made therein without departing from the scope of the invention encompassed by the appended claims.

The invention claimed is:

1. A container-mounted beverage dispensing system, the container having a longitudinal axis, the system comprising:

at least one conduit to deliver gas into a container holding a beverage and to receive beverage from the container for dispensing in a user's cup;

at least one valve to control gas flow into the container or beverage flow out of the container via the at least one conduit;

a container orientation sensor to detect rotation of the container about the longitudinal axis while in a pour orientation; and a controller arranged to control the at least one valve to prohibit gas or beverage flow in response to rotation of the container about the longitudinal axis while in the pour orientation.

2. The system of claim 1, wherein the at least one conduit includes a single conduit to deliver gas into the container and receive beverage from the container.

3. The system of claim 2, wherein the single conduit is part of a needle arranged to be inserted through a cork in an opening of the container.

4. The system of claim 1, wherein the at least one conduit includes a first conduit to deliver gas into the container and a second conduit to receive beverage from the container.

5. The system of claim 4, wherein the first and second conduits are part of a needle arranged to be inserted through a cork in an opening of the container.

6. The system of claim 1, further comprising a source of pressurized gas fluidly coupled to the at least one conduit.

7. The system of claim 6, wherein the at least one valve includes a gas control valve arranged to control flow of gas from the source of pressurized gas to the at least one conduit.

8. The system of claim 1, wherein the at least one valve includes a beverage control valve arranged to control flow of beverage from the at least one conduit to a beverage outlet.

9. The system of claim 1, wherein the orientation sensor is arranged to detect the pour condition when a bottom of the container is above an opening of the container, and the controller is arranged to control the at least one valve to allow gas or beverage flow in the at least one conduit when the container is in the pour orientation and to control the at least one valve to prohibit gas or beverage flow when the container is in a no-pour orientation.

10. The system of claim 1, wherein the orientation sensor is arranged to detect the pour condition when a longitudinal axis of the container is rotated about a horizontal axis by at least 90 degrees, and the controller is arranged to control the at least one valve to allow gas or beverage flow in the at least one conduit when the container is in the pour orientation and to control the at least one valve to prohibit gas or beverage flow when the container is in a no-pour orientation.

11. The system of claim 1, wherein the controller is arranged to close the at least one valve to prohibit flow of pressurized gas into the container in response to rotation of the container about the longitudinal axis while in the pour orientation.

12. A beverage dispensing device, comprising:

a base including a clamp configured to engage with a neck of a beverage container to support the beverage dispensing device on the beverage container;

a body movably mounted to the base between upper and lower positions and having a needle attached to and extending from the body, the needle being arranged to be inserted through a closure of the beverage container to introduce gas into the beverage container and extract beverage from the container;

a container sensor configured to detect that the container neck is engaged by the clamp; and a controller configured to configured to detect that the needle has been inserted through the closure, the controller configured to enable beverage dispensing via the needle if the container sensor detects engagement of the clamp with the beverage container and the controller detects that the needle has been inserted through the closure.

13. The device of claim 12, further comprising at least one valve to control gas flow into the beverage container, and wherein the controller is configured to control the at least one valve to enable gas flow into the beverage container if the container sensor detects engagement of the container with the base and the controller detects the needle has been inserted through the closure.

14. The device of claim 12, wherein the container sensor includes a switch to detect that the clamp is engaged with the container neck.

15. The device of claim 12, wherein the controller includes a pressure sensor configured to detect that the needle is in fluid communication with an interior space of the beverage container.

16. The device of claim 12, wherein the controller includes a sensor configured to detect contact of beverage with the needle.

17. The device of claim 12, wherein the controller includes a pressure sensor is configured to detect pressure at an interior space of the beverage container.

18. The device of claim 12, wherein the base includes a needle guide arranged to guide movement of the needle through the closure of the container.

19. The device of claim 12, wherein the controller includes a container orientation sensor arranged to detect an orientation of a container engaged by the clamp, the controller being arranged to deliver pressurized gas to the needle when the container orientation sensor detects the beverage container engaged by the clamp is oriented to pour beverage from the beverage container.

20. The device of claim 19, wherein the controller is arranged to deliver suitable pressurized gas into the container via the needle to dispense a defined volume of beverage.

21. The device of claim 12, wherein the clamp includes two clamp arms that are opposed to each other and biased towards each other to engaged the container neck.

22. The device of claim 12, further comprising a source of pressurized gas fluidly coupled to the needle, and at least one valve to control pressurized gas flow from the source of pressurized gas into the beverage container, wherein the controller is configured to control the at least one valve to enable pressurized gas flow into the beverage container if the container sensor detects engagement of the container with the base and the controller detects the needle has been inserted through the closure.

* * * * *